US005897442A

United States Patent [19]

Honderd

[11] Patent Number: 5,897,442

[45] Date of Patent: Apr. 27, 1999

[54] GOLF PRACTICE AND TRAINING DEVICE

[76] Inventor: Norman J. Honderd, 405 NW. Applewood, Ankeny, Iowa 50021

[21] Appl. No.: 08/988,737

[22] Filed: Dec. 11, 1997

[51] Int. Cl.[6] ..... A63B 69/36

[52] U.S. Cl. ..... 473/218; 473/272; 273/DIG. 30

[58] Field of Search ..... 473/270, 272, 473/218; 273/DIG. 30

[56] References Cited

U.S. PATENT DOCUMENTS

| | | | |
|---|---|---|---|
| 2,790,642 | 4/1957 | Rolfe | 473/272 |
| 4,478,422 | 10/1984 | Blanchard | 473/272 |
| 5,398,937 | 3/1995 | Regan | 273/DIG. 30 |
| 5,411,266 | 5/1995 | Guthry | 273/187 |

*Primary Examiner*—George J. Marlo

*Attorney, Agent, or Firm*—Zarley, McKee, Thomte, Voorhees & Seas

[57] ABSTRACT

A golf practice and training guide to assist a golfer in identifying and replicating a preferred ball position. The golf practice and training device includes a first and second alignment guides pivotally mounted on the ground and spaced apart such that the alignment guides are capable of pivoting towards each other and intersecting at a point proximate a preferred ball position. The invention also includes a method for determining a golfer's preferred ball position and capturing that ball position for future practice sessions.

6 Claims, 6 Drawing Sheets

GOLF PRACTICE AND TRAINING DEVICE

FIELD OF THE INVENTION

The present invention pertains to a golf practice and training device used to identify and replicate a preferred ball position in a golfer's setup.

BACKGROUND OF THE INVENTION

Golfers of all skill levels seek to improve their ball-striking abilities. Much of the golf swing is dictated by the golfer's address position or setup. A golfer's setup includes such things as the grip, body posture, weight distribution, and ball position.

An incorrect ball position is a source of many problems. Placing the ball either too far forward or too far backward in a golfer's stance results in hooks, slices, and a ball flight trajectory that is either too high or too low. Similarly, standing either too far from or near to the ball can produce the same errant shots. Not surprisingly, a golfer tends to spend a great deal of practice time determining the correct ball position for a particular club and learning to consistently setup to the golf ball with that same ball position.

A golf teaching professional and others skilled at the game can aid the golfer in determining his or her correct ball position for a particular club. The teacher can also monitor the golfer's ball position during a practice session to ensure that the golfer is establishing a consistent ball position. For many golfers, however, it is not feasible to have a golf professional constantly check their ball position during a practice session. Thus, there is a need in the art for a golf practice and training device that will enable a golfer to both identify and replicate a preferred ball position.

It can therefore be seen that there is a real and continuing need for the development of a golf practice and training device that will enable a golfer to consistently place the ball in a correct position in the golfer's stance.

The primary objective of the present invention is the provision of a golf practice and training device that allows the golfer to identify and capture a preferred ball position during a practice session for use in future practice sessions.

Another objective of the present invention is the provision of a method for identifying a preferred ball position in a golfer's setup.

Still another objective of the present invention is the provision of a golf practice and training device which is efficient in operation, economical to manufacture, and durable in use.

SUMMARY OF THE INVENTION

The golf practice and training device of the present invention includes a first alignment guide adapted to lie on the ground and pivot about a first pivot point, and a second alignment guide adapted to lie on the ground and pivot about a second pivot point towards the fist alignment guide. The first and second pivot points are spaced apart such that the first and second alignment guides are capable of pivoting towards each other and intersecting at a point proximate a ball position. The golf practice and training device also includes a means for identifying the point at which the first and second alignment guides intersect proximate the preferred ball position.

The present invention also includes a method for identifying a preferred ball position in a golfer's setup. The preferred method includes determining through practice a preferred ball position between the first and second alignment guides, pivoting the first and second alignment guides towards each other to a point at which they intersect proximate the preferred ball position, and then identifying that preferred ball position.

DETAILED DESCRIPTION OF THE PREFERRED EMBODIMENT

Figure 1:
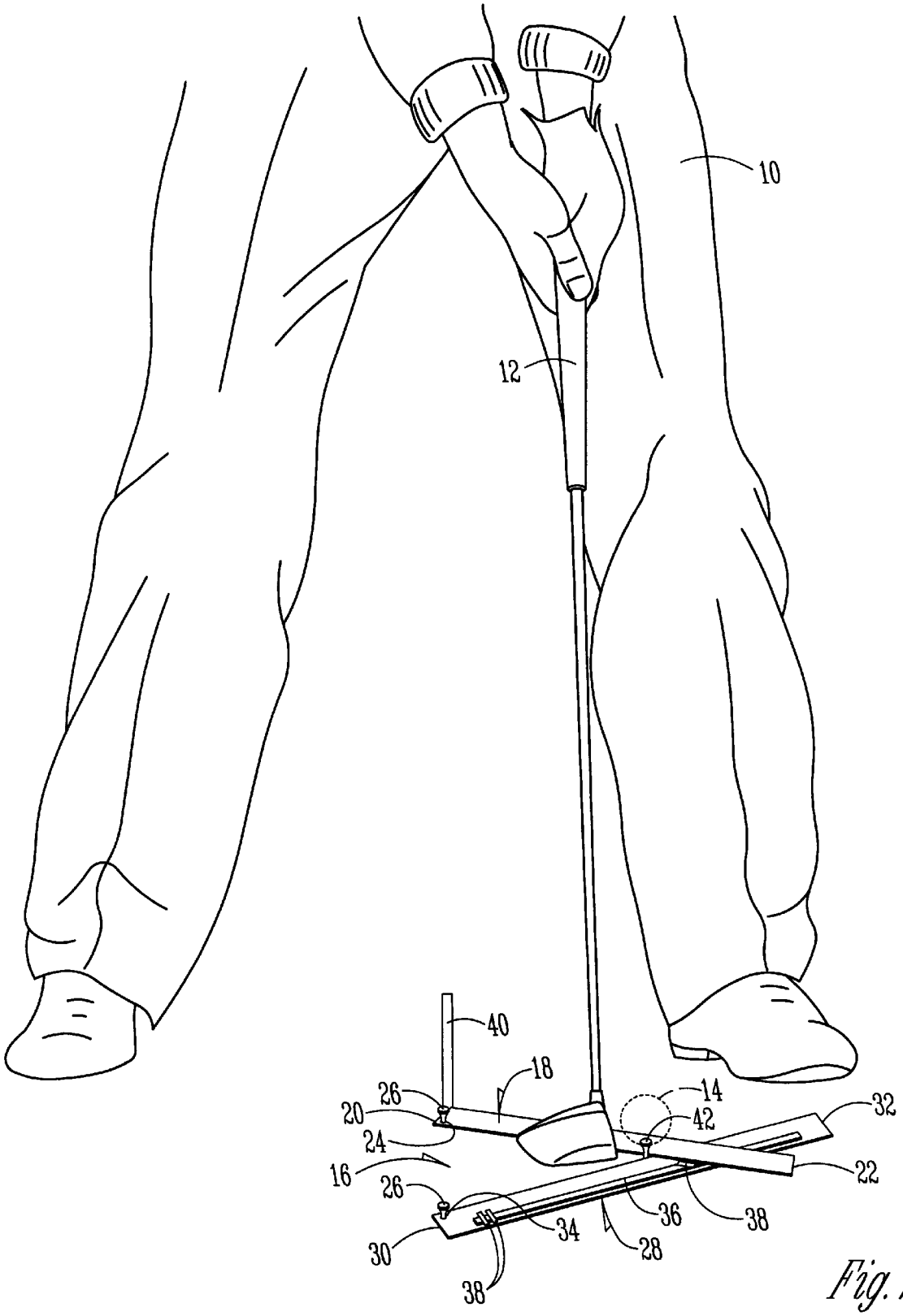
FIG. 1 is a perspective view showing a golfer in the address position using the golf training and practice device of the present invention.

FIG. 1 shows a golfer 10 holding a golf club 12 and addressing a golf ball 14 in a setup position. The golf practice and training device of the present invention 16 includes an elongated first alignment guide 18 having a first end 20 and a second end 22. The first alignment guide 18 is pivotal about a first pivot point 24 proximate its first end 20 in a substantially horizontal plane. Similarly, an elongated second alignment guide 28, having a first end 30 and a second end 32, is pivotal in a substantially horizontal plane about a second pivot point 34 proximate its first end 30. It is preferred that a golf tee 26 (also referred to as a system tee) or similar item be inserted through the first and second alignment guides (18 and 28) at the first and second pivot points (24 and 30) to enable the pivotal movement.

As shown in FIGS. 2–5, the first and second pivot points 24 and 30 are spaced apart such that the first and second alignment guides 18 and 28 intersect when pivoted towards each other. The principal feature of the present invention is the ability of the first and second alignment guides 18 and 28 to intersect at a point proximate a preferred ball position (see FIGS. 1, 3–5).

The golf practice and training device 16 also includes a means for identifying the point at which the first and second alignment guides 18 and 28 intersect. As shown most clearly in FIGS. 3–5, the second alignment guide 28 includes a Velcro pad 36 that runs almost the entire length of the second alignment guide 28. A plurality of Velcro strips 38 are also provided. The Velcro strips 38 adhere to the Velcro pad 36 and a golfer may easily remove and replace the Velcro strips 38 at different locations along the Velcro pad 36. A Velcro strip 38 is used to mark the angle at which the first alignment guide 18 intersects the second alignment guide 28. As shown in FIG. 4, more than one Velcro strip 38 may be used to identify different ball positions. For example, one Velcro strip 38 may identify the golfer's preferred ball position with a driver and another strip identifies the golfer's preferred ball position with a five-wood. To this end, it is preferred that the different Velcro strips 38 be easily identified by color or other means corresponding to a particular ball position for a particular club.

It should be understood that the Velcro pad 36 and strip 38 as described above is but one of many possible means for identifying a point of intersection of the first and second alignment guides 18 and 28. For example, one of the alignment guides could include indicia, much like a ruler, for identifying the point of intersection. In addition, the angle of intersection could be traced onto the corresponding alignment guide using an erasable marker.

To ensure that a preferred ball position can be replicated from one practice session to the next, it is important that the pivot points 24 and 34 maintain a consistent spacing and alignment. It is therefore preferred that both the first and second pivot points 24 and 34 be aligned at the center of the golfer's stance and perpendicular to the target line 44 (see FIG. 2). A setup guide 40 is provided to help the golfer 10 identify the center of his stance. The setup guide 40 is also pivotally mounted about the first pivot point 24 by insertion of the system tee 26 through both the first alignment guide 18 and the setup guide 40. As with the first alignment guide 18, the setup guide 40 is pivotally mounted in a generally horizontal plane.

The center of the golfer's stance corresponds generally with the bottom of the golfer's swing arc. One fundamental of good ball striking is that the club head 46 travels in a path along the target line 44 when it reaches the bottom of the golfer's swing arc on the down swing. The tees 26 provide the golfer with feedback as to his club path at the bottom of his swing arc. With the tees 26 spaced approximately ¼ inch outside the toe and heel of the club head 46, contact with one of the tees 26 may indicate that the golfer is standing either too close to or too far away from the ball. Ideally, the club head 46 will pass between the tees 26 along the target line 44.

Figures 6, 7, 8:
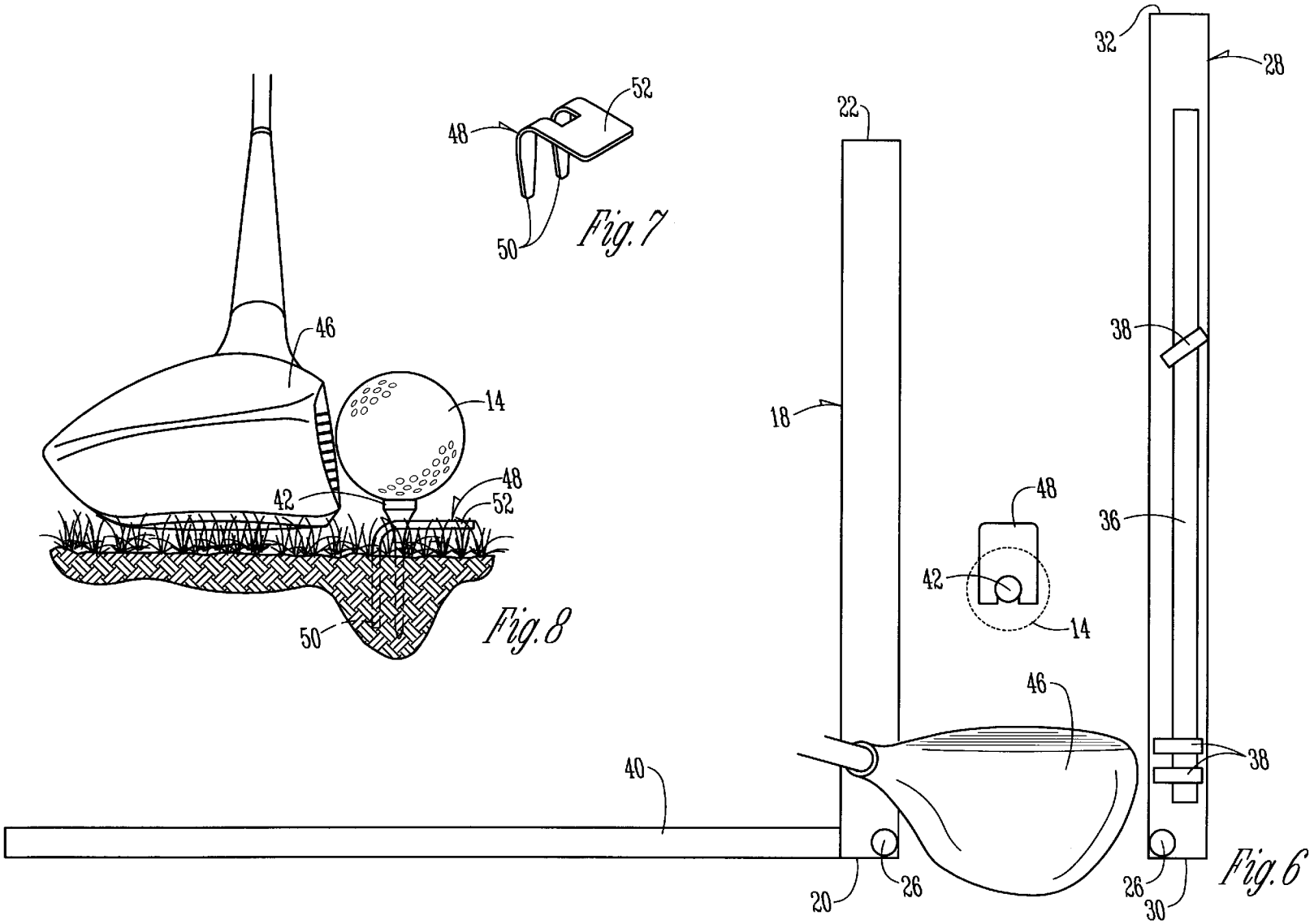
FIG. 6 is another top elevational view of the golf practice and training device.
FIG. 7 is a perspective view of a tee location marker used with the present invention.
FIG. 8 is a side view of the tee location marker used to identify a ball position during a practice session.

A tee location marker 48 may also be used with the present invention (see FIGS. 6–8). It is often difficult to maintain a consistent tee location from swing to swing, as the tee may become dislodged from the ground after impact. The function of the tee location marker 48 is to identify the current tee location before and after each swing. It should be understood that the tee location corresponds generally with the golfers ball position, as the golf ball is supported by the tee. The tee location marker 48 includes two prongs 50 extending from a base portion 52. A golf tee 42 is disposed between the prongs 50 adjacent the base portion 52. Each of the prongs 50 includes a downwardly extending portion and an arcuate section. The downwardly extending portions of the prongs 50 are inserted into the ground and secure the tee location marker 48 to the ground from one swing to the next. In its preferred form, the tee location marker is integrally formed and includes a protective rubber or plastic coating so as not to cause damage to the club head 46.

The first and second alignment guides 18 and 28 may be made from a variety of materials. A plastic or rubber material is preferred to avoid any possible damage to the club head 46 through contact.

The method of using the golf practice and training device 16 will now be described in detail. In determining a preferred ball position, the golfer first places the first and second alignment guides 18, 28 on the ground in a spaced apart and substantially parallel relationship (see FIG. 2). In this manner, the first and second alignment guides 18, 28 are also substantially parallel to the target line 44. This, among other things, helps the golfer to visualize a proper swing path. The setup guide 40 is positioned perpendicular to the first alignment guide 18 and extends toward the center of the golfer's stance corresponding to the bottom of the swing arc. The tee 26 and corresponding first and second pivot points 24 and 34 are aligned with the setup guide 40. It is preferred that the first and second alignment guides 18 and 28 be spaced apart approximately ¼ inch outside the toe and heel of the club head 46.

Next, the golfer determines through practice a preferred ball position between the first and second alignment guides 18 and 28. The tee location marker 48 is helpful in identifying the current ball position from one swing to the next.

Figure 3:
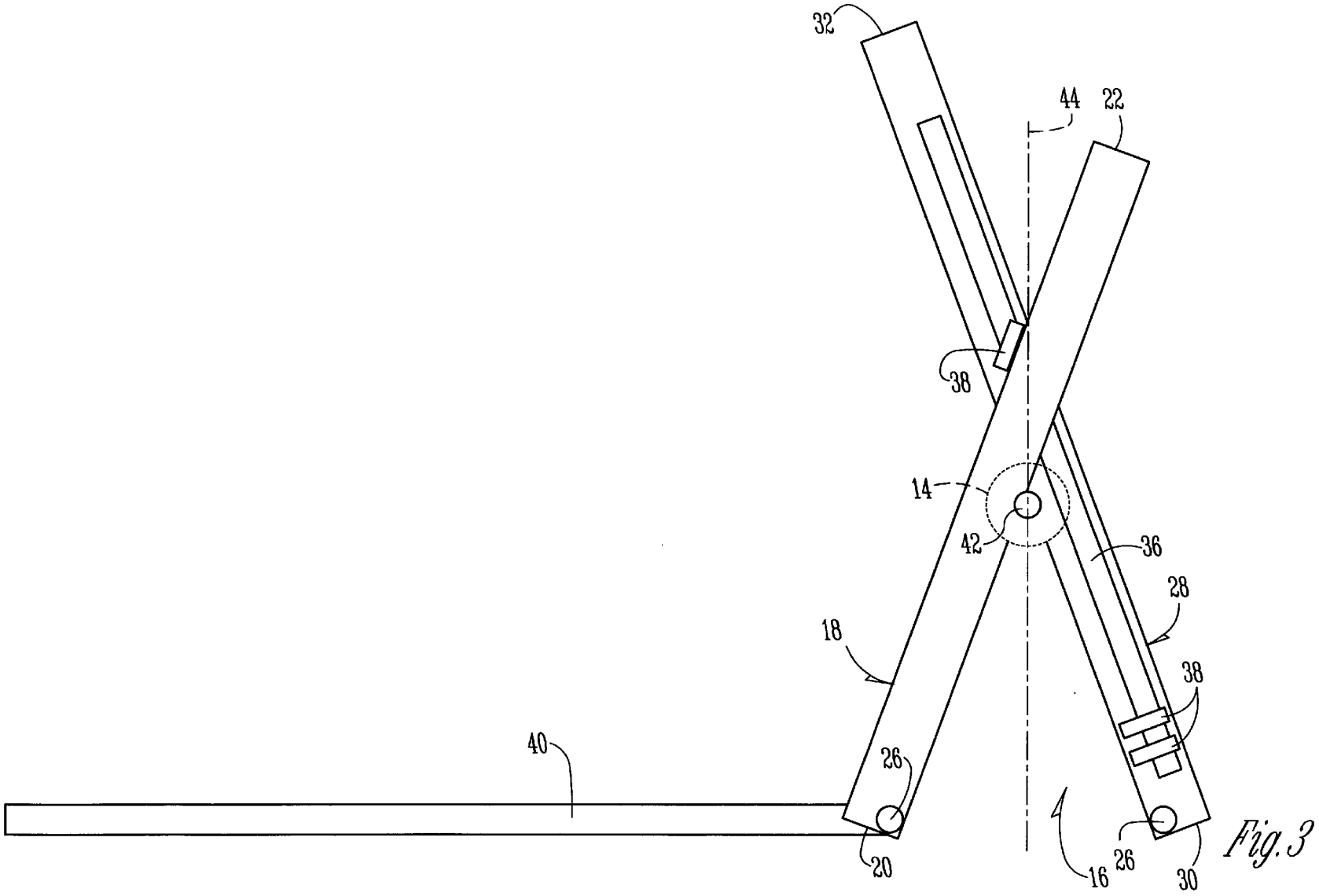
FIG. 3 is a top elevational view of the golf practice and training device as shown in FIG. 1.
Figure 4:
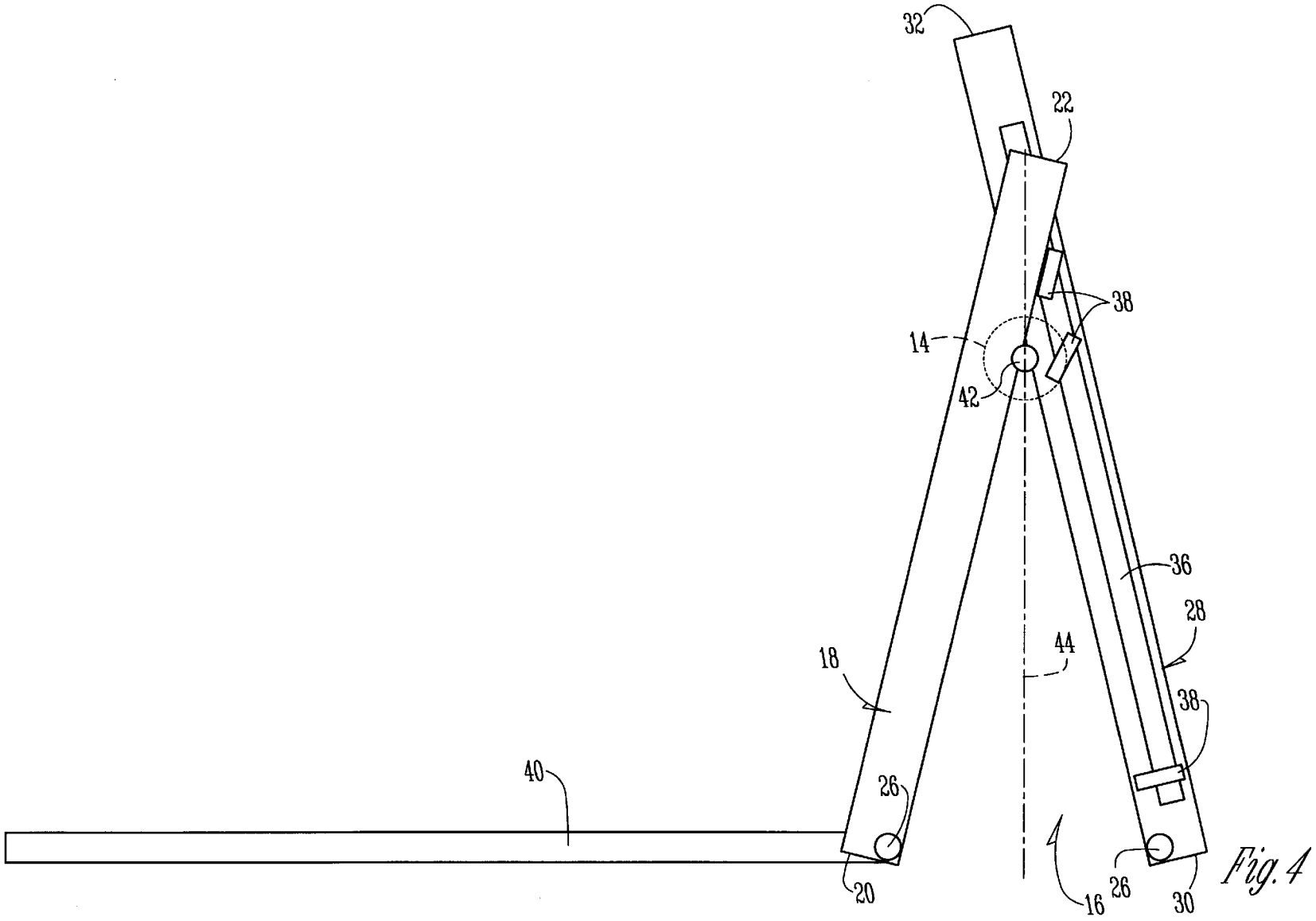
FIG. 4 is a top elevational view of the golf practice and training device showing the identification of an alternative ball position.
Figure 5:
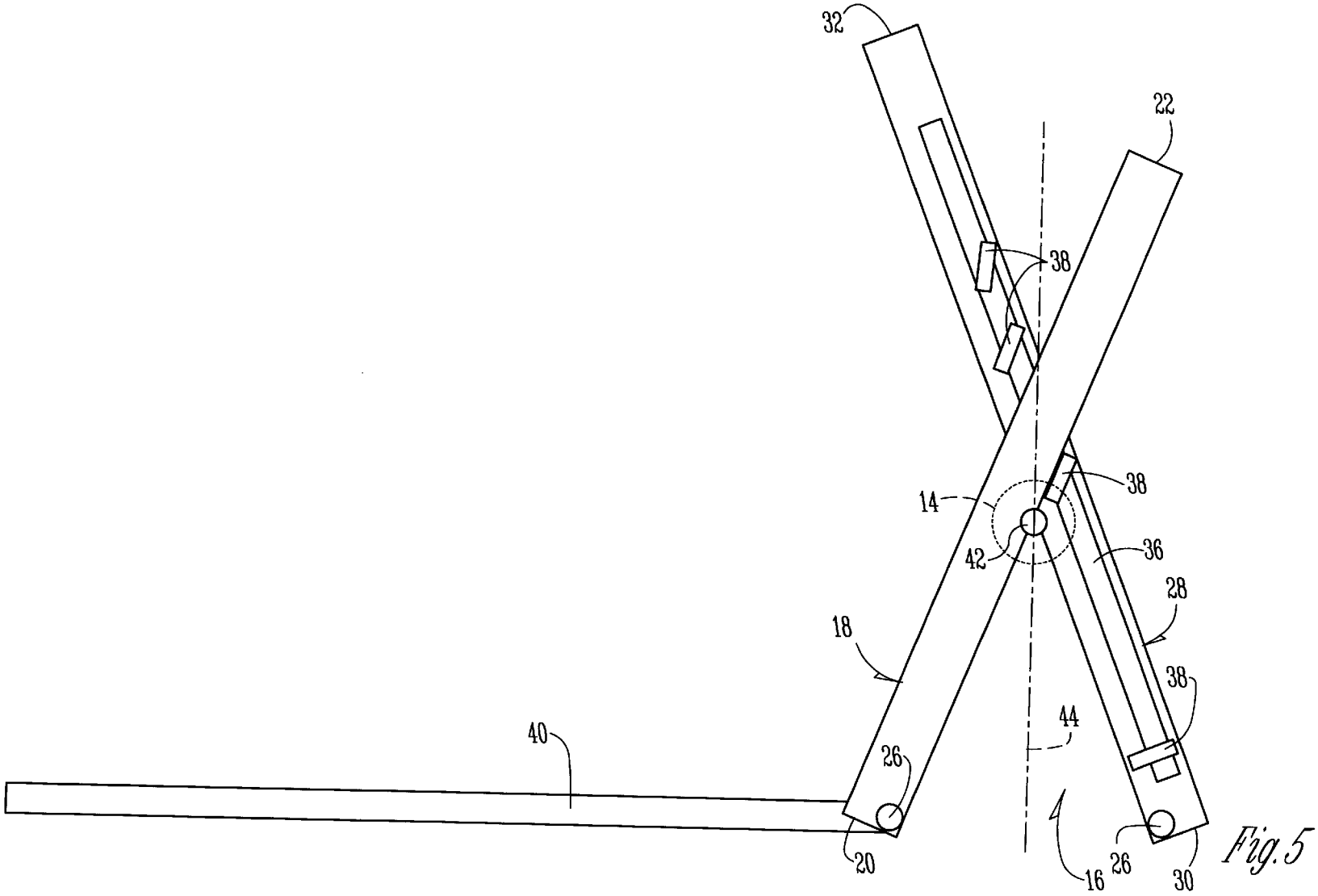
FIG. 5 is a top elevational view similar to FIG. 4.

Once a preferred ball position is determined for a selected club, i.e., one that results in a preferred shot shape, the first and second alignment guides 18 and 28 are pivoted towards each other until they intersect in a point at the tee location (see FIGS. 3–5). The golfer then identifies the angle at which the first alignment guide 18 intersects the alignment guide 28 by removing one of the Velcro strips 38 and placing it in an abutting relationship with one of the side edges of the first alignment guide 18. Note that the system tees 26 and the preferred tee location or ball position will not necessarily form an isosceles triangle, as the preferred tee location may be nearer either the first or second alignment guide (18, 28).

The golfer may then change clubs and repeat the above steps to find another preferred ball position and mark it with a different Velcro strip 38, as the preferred golf position may vary from club to club. For example, the golfer's preferred ball position may change from a driver to a three-wood.

By the end of the practice session, the golfer has recorded one preferred ball position per club that can be replicated during future practice sessions. It is in this way that the golfer develops a consistent ball position and builds muscle memory.

Figure 2:
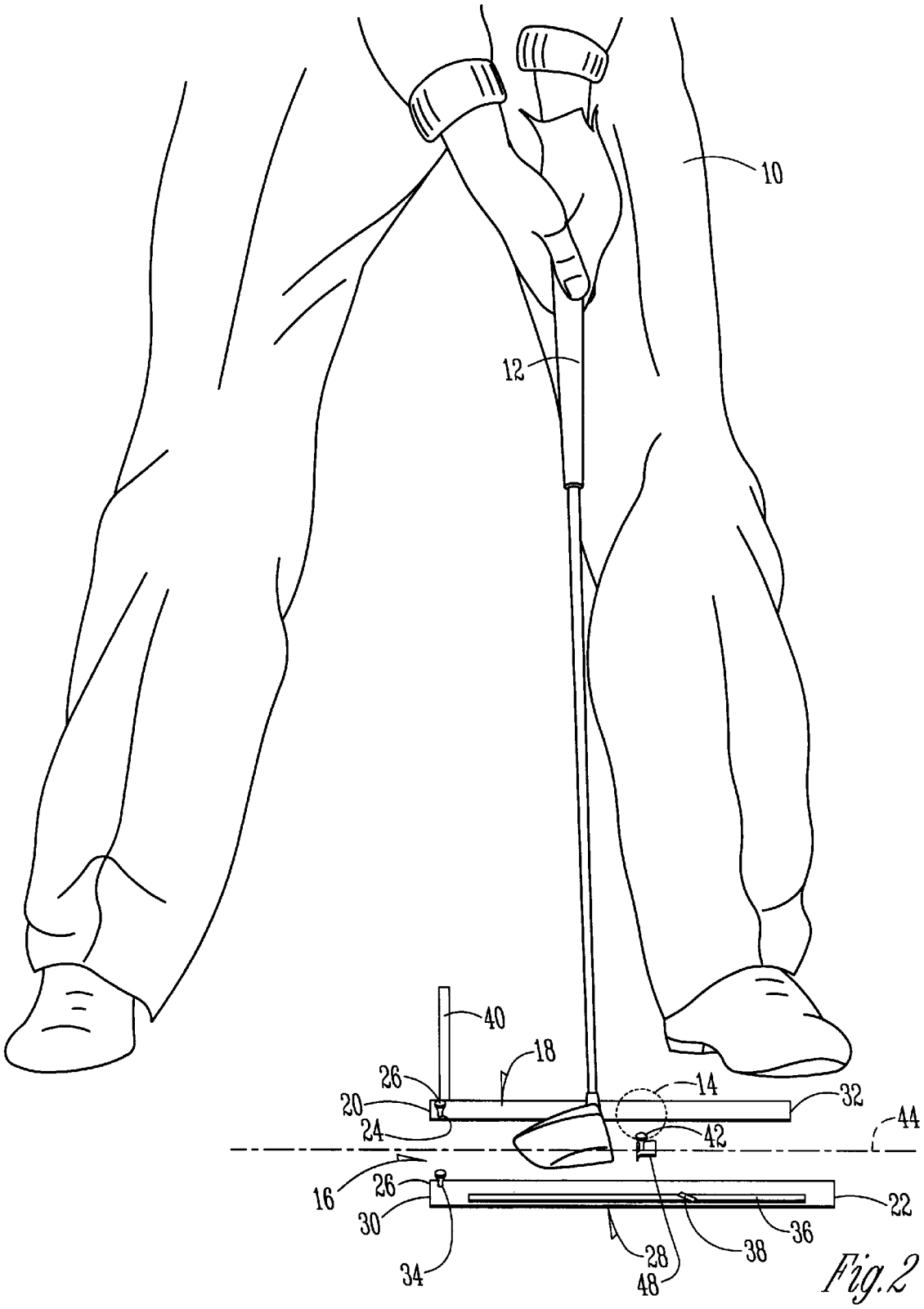
FIG. 2 is a perspective view similar to FIG. 1.

When the golfer returns in a subsequent practice session, the golf practice and training device 16 is again positioned on the ground as described above, however, the first and second alignment guides 18 and 28 are first pivoted towards each other to the point of intersection marked by a Velcro strip 38 corresponding to a preferred ball position. A tee 42 is then inserted at the point proximate the point of intersection of the first and second alignment guides 18 and 28 (see FIG. 3–5). Next, the first and second alignment guides 18 and 28 are pivoted away from each other to a substantially parallel position as shown in FIG. 2.

The present invention may also be used with an artificial grass mat (not shown) and a "stationary" tee (not shown), such as found in indoor driving ranges and the like. Because the stationary tee cannot be easily moved, the first and second alignment guides (18, 28) must first be positioned intersecting the stationary tee and then rotated such that the system tees 26 (or other similar means of identification) are aligned at the center of the golfer's stance. Note also that with an artificial grass mat, a second grid, with indicia for placement of the system tees or other identification means, could provide a substitution for the first and second alignment guides (18, 28).

Whereas the invention has been shown and described in connection with the preferred embodiments thereof, it will be understood that many modifications, substitutions, and additions may be made which are within the intended broad scope of the following claims.

From the foregoing, it can be seen that the present invention accomplishes at least all of the state objectives.

What is claimed is:

1. A golf practice and training device for enabling a golfer to identify and replicate a preferred ball position, the golf practice and training device comprising:

a first elongated alignment guide having a first end and a second end, the first alignment guide is adapted to lie on the ground, establish a substantially straight target line and pivot about a vertical axis proximate its first end;

a second elongated alignment guide having a first end and a second end, the second alignment guide is adapted to lie on the ground spaced apart from and in a substantially parallel relation to the first alignment guide and pivot about a vertical axis proximate the first end of the first alignment guide;

the first and second alignment guides are spaced apart and capable of pivoting towards each other and intersecting at a point proximate a ball position;

an elongated setup guide adapted to lie on the ground and extend from the first end of the first alignment guide toward a golfer's stance; and means for identifying the point at which the first and second alignment guides intersect proximate the ball position.

2. The golf practice and training device of claim 1 wherein the means for identifying the point includes hook and loop fasteners mounted on the first and second alignment guides for identifying the angle at which the first or second alignment guides intersect.

3. The golf practice and training device of claim 2 wherein the means for identifying the point includes a plurality of hook and loop fasteners for identifying different ball positions.

4. The golf practice and training device of claim 1 wherein the setup guide is adapted to pivot about a vertical axis proximate the first end of the first alignment guide.

5. The golf practice and training device of claim 1 wherein the first ends of the first and second alignment guides are aligned substantially perpendicular to the target line.

6. The golf practice and training device of claim 1 further comprising a tee location marker for identifying the ball position before and after a golf swing.

* * * * *